US005553410A

United States Patent [19]

Derby

[11] Patent Number: 5,553,410

[45] Date of Patent: Sep. 10, 1996

[54] COLLAR PRESSING PAD FOR DRESS SHIRTS

[76] Inventor: Jeanine Derby, 920 N. Brainard, Naperville, Ill. 60663

[21] Appl. No.: 459,750

[22] Filed: Jun. 2, 1995

[51] Int. Cl.[6] ..... D06F 71/22; D06F 83/00

[52] U.S. Cl. ..... 38/13; 38/66

[58] Field of Search ..... 38/12, 13, 16, 38/20, 95, 63, 64, 66–68, 108, 109, 110, 140, 141; 223/81

[56] References Cited

U.S. PATENT DOCUMENTS

| | | | |
|---|---|---|---|
| 1,976,576 | 10/1934 | Patterson | 38/66 |
| 2,013,004 | 9/1935 | Marcellitti | 68/9 |
| 2,036,964 | 4/1936 | Galvin | 38/66 |
| 2,136,564 | 11/1938 | Ricketson | 38/66 |
| 2,264,644 | 12/1941 | Santangelo | 38/140 |
| 2,325,907 | 8/1943 | Downer et al. | 38/66 X |
| 2,410,208 | 10/1946 | Gauldin | 68/235 |
| 2,619,268 | 11/1952 | Asher | 233/52.1 |
| 4,890,401 | 1/1990 | Weisfeld | 38/43 |

*Primary Examiner*—Ismael Izaguirre
*Attorney, Agent, or Firm*—Welsh & Katz, Ltd.

[57] ABSTRACT

A pad for use on a collar pressing apparatus which has a lower buck and pressing head adapted to press against and iron a collar which has been placed in the open position between the buck and head. The collar has an outer fold portion with a lateral edge and a button attached to a cloth extender which extends laterally outward from the lateral edge. The pad is removably attached to the buck and is formed with a first section configured to allow the collar to be spread out in the open position thereon. On a side portion of the first section, an area is formed for receiving the button attached to the extender. The area is thinner than the thickness of the pad when the pressing head is pressed against the pad so as to accommodate the button. By placing the button in the thinner area, the forced exerting by the pressing head on the button is reduced to prevent the fracture of the button.

9 Claims, 1 Drawing Sheet

FIG. 1
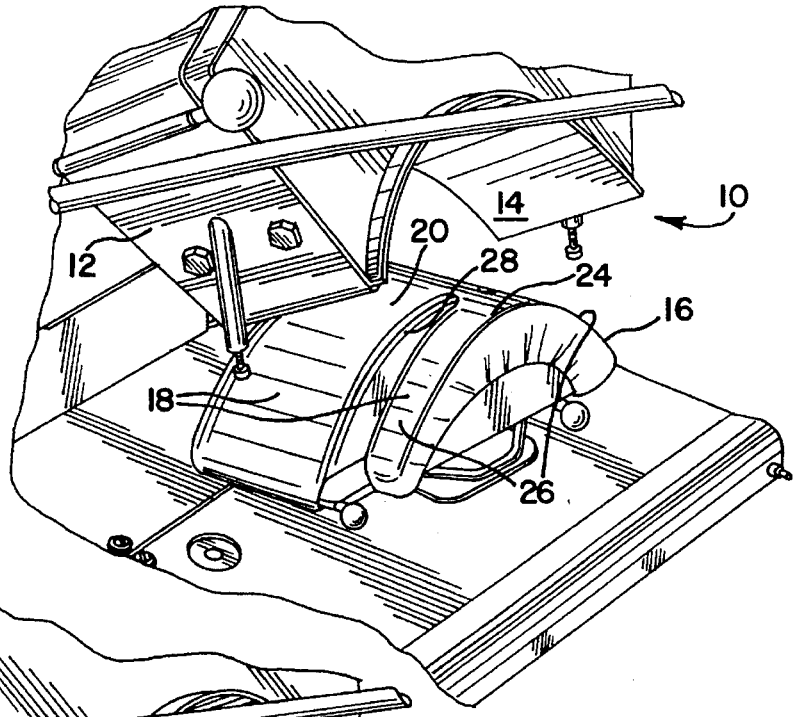
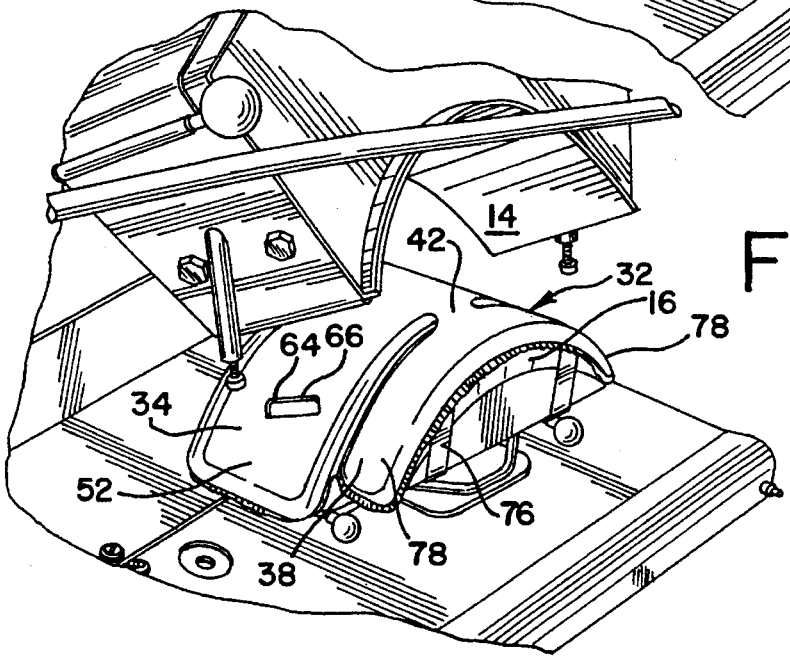
FIG. 2
FIG. 3
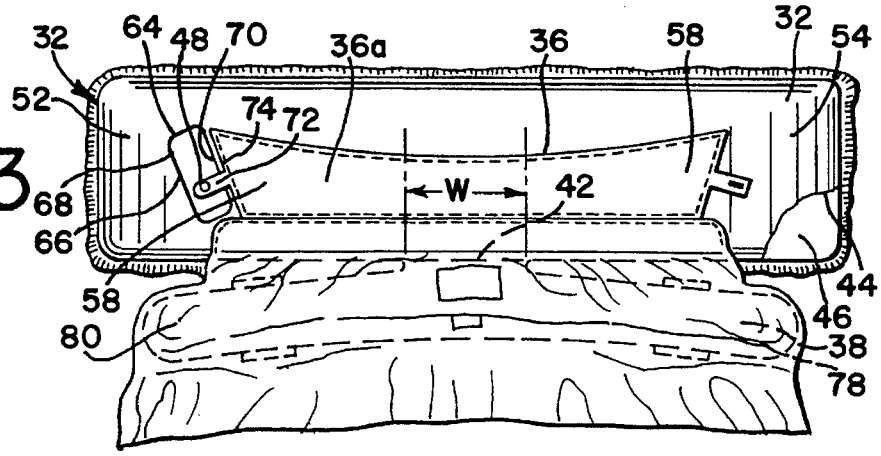

COLLAR PRESSING PAD FOR DRESS SHIRTS

FIELD OF THE INVENTION

This invention generally relates to a textile pressing apparatus, and more particularly to a pressing apparatus for shirts with collars having a buttoning arrangement for attaching opposing collar ends when the collar is worn about the neck.

BACKGROUND OF THE INVENTION

Dress shirts, and in particular men's dress shirts, are typically cleaned in dry cleaning establishments. The general process is to first launder the shirt and then press the shirt on pressing devices specifically configured to press different areas of the shirt.

As is well known, pressing generally involves the placing of a certain portion of the shirt on a pressing buck and then applying a heating pressing head to press the shirt between the buck and pressing head. One of the drawbacks of using pressing bucks and pressing heads is that a large amount of force and heat is applied to buttons on the shirt. This force and heat leads to button breakage. Before returning the shirt to the customer, these buttons must be replaced which increases the cost of the cleaning.

One style of men's shirt includes a collar with lateral ends which may be buttoned together typically under the tie. This is accomplished by placing a button on the end of a small cloth extender which extends from one of the lateral edges of the collar. A cloth extender which extends from the other lateral edge of the collar forms a button hole. When the collar is worn about the neck, the lateral edges of the collar are opposing each other on each side of the tie and may be drawn toward each other and held in that position by buttoning the button in the button hole. These collars, however, present a particular problem in pressing. Typically the collar is laid out upon the buck and the pressing head is brought down upon the collar to apply a pressing force and heat. This force and heat is also applied on the button causing the collar button to shear in many cases.

It is therefore an object of the present invention to provide an improved collar pressing apparatus for pressing shirt collars while reducing the incidents of button breakage due to the pressing of the collar.

Another object of the present invention is to provide a improved device which may be used with a collar pressing apparatus to facilitate the pressing of collars while reducing the breakage of any buttons or snaps attached to the collars. A related object is to provide such a device which may be easily attached and detached from the collar pressing apparatus so it may be selectively employed for those shirts having buttons or snaps on the collar.

A still further object of the present invention is to provide an improved device for use with collar pressing apparatus to protect buttons or snaps located on the collar but which does not interfere with the normal pressing action on the collar.

Yet another object of the present invention is to provide a device which may be used with a collar pressing apparatus to protect collar buttons or snaps and which may be easily used to protect the buttons whether the buttons are attached to one side of the collar or the other.

SUMMARY OF THE INVENTION

The above objects are met and exceeded by an assembly including a collar pressing apparatus which has a lower buck and pressing head adapted to press against and iron a collar which has been placed in the open position between the buck and head. The collar has an outer fold portion with a lateral edge and a button attached to a cloth extender which extends laterally outward from the lateral edge. The pressing assembly also includes a pad which is removably attached to the buck and covers a portion of the buck. The pad has a generally resilient first layer which may be compressed to a certain thickness by the pressing of the pressing head against the pad and buck. The resilient layer is covered with a heat resistant upper surface, and the pad is formed with a first section configured to allow the collar to be spread out in the open position thereon. On a side portion of the first section, an area is formed for receiving the button attached to the extender. The area is preferably a hole or slot through the resilient layer so as to accommodate the button when the pressing head is pressed against collar on the pad. By placing the button in the hole, the force exerted by the pressing head on the button is reduced to prevent the fracture of the button.

In particular, the hole extends through the pad. The hole is defined by a peripheral border. An inner side section of the peripheral border is configured to be aligned with the lateral edge of the outer fold portion of the collar when the collar is laid upon the pad. Having the inner side aligned with the edge of the collar prevents the wrinkling of the collar by the pressing action of the pressing head against the collar and pad. The pad may also include resilient straps to removably secure the pad to the buck and also allow limited controlled movement relative to a buck to accommodate collars having outer folds of different lateral widths.

BRIEF DESCRIPTION OF THE DRAWINGS

FIG. 1 is a perspective view showing of a typical shirt collar pressing apparatus;

FIG. 2 is a perspective view of the collar pad constructed in accordance with the invention with the pad placed on the collar pressing apparatus of FIG. 1; and FIG. 3 is a partial top plan view of the pad of FIG. 2 with a shirt collar spread in the open position on the pad for pressing.

DESCRIPTION OF THE PREFERRED EMBODIMENTS

Referring to FIG. 1, a pressing apparatus particularly adapted for pressing a collar of dress shirts is generally indicated at 10. The pressing apparatus 10 includes a pivotally mounted pressing head 12. The pressing head 12 includes a concavely curved, lower surface 14 which is heated typically by internal resistance heaters or the like. The pressing head 12 may be pivoted to press the lower surface 14 against a lower buck 16 which has an upper surface 18 convexly curved to match the configuration of the lower surface 14.

The buck 16 is formed with a rear region 20 having a generally rectangular periphery with rounded corners. The buck 16 also has a forward region 24 formed by two lobes 26 which extend forward from the center of the rearward region 20. Each of the lobes 26 extends outward from a forward peripheral edge 28 of the rear region to form an acute angle between the forward edge 28 and lobe. Referring to FIGS. 2 and 3, a collar pressing pad constructed in accordance with the present invention is generally indicated at 32. The pad 32 includes a rear or first section 34 which is configured to extend over at least a portion or preferably the entire rear region 20 of the lower buck 16. Referring in particular to FIG. 3, the rear section 34 is configured to have a width so that a shirt collar 36 may be spread out in the shown open position. The collar 36 has an outer fold portion 36*a*, which when the shirt is worn, the outer fold portion covers the extension of a tie (not shown) about the neck of the wearer.

The pad 32 also has a forward or second section 38 which is configured to cover the lobes 26 of the lower buck 16. The forward section 38 is connected to the rearward section 34 at a yoke 42. It has been found that the width "W" (FIG. 3) of the yoke 42 has an impact on the ability to press a collar 36 without wrinkling the collar. In the preferred embodiment, the width "W" of the yoke is approximately 6.25 centimeters.

The pad 32 is formed with outer layers 44 composed of heat resistant fabric of a type commonly used on lower bucks 16. The upper layer 44 covers a generally resilient middle layer 46 which is typically composed of cloth or the like. The resilient middle layer 46 is formed so that when the pressing head is pressed against the pad, the resilient middle layer 46 compresses to a compressed thickness. The compressed thickness of the middle layer 46 is typically thicker than the thickness of a collar button 48 which is attached to the outer fold 36*a* of the collar 36. The middle layer 46 is not necessarily resilient; however, a resilient layer promotes the pressing of the collar 36.

The rearward section 34 of the pad 32 has a left side portion 52 and right side portion 54 over which lateral edge portions 58 of the outer fold 36*a* of the collar 36 are placed. The left side portion 52 forms an area 64 having a thickness which, when the pressing head 12 is pressed against the pad 32, is less than the compressed thickness of the pad 32. The area 64 is located in the left side portion 52 so that when the collar 36 is placed in the open position on the rearward section 34 of the pad 32, the collar button 48 lies within the area 64. The area 64 is preferably a hole 66 which extends through the pad 32, but other methods of forming the area 64 having a thickness less than the compressed thickness of the pad 32 are contemplated.

In the preferred embodiment, the hole 66 is defined by a peripheral edge 68. To avoid forming a wrinkle line on the collar 36 caused by pressing the collar against the peripheral edge 68, an inner side section 70 of the peripheral edge is angled to be aligned with a lateral edge 74 of the outer fold 36*a* the collar. The hole 66 is formed with a width which allows the collar button 48, which is attached to an extender 72, to be within the hole when the lateral edge 74 of the collar is aligned with the inner side section 70 of the peripheral edge 68.

To removably attach the pad 32 to the buck 16, the pad includes a pair of elastic straps 76. Each of the straps 76 extends downward from one of the lobes 78 of the forward section 38 of the pad 32 and extend about the lower surface of the lobes 26 of the buck 16. The elasticity of the straps 76 maintain the attachment of the pad 32 to the buck 16 and yet allow the rear section 34 of the pad to be moved relative to the rear region 20 of the buck 16 to allow for adjustment of the location of the hole 66 for collars 36 having outer folds of different widths.

In use, the user determines that the collar 36 to be pressed has a collar button 48 attached to an extender 72. The pad 32 is then placed on the buck 16 so that the rear section 34 of the pad extends over the rearward region 20 of the buck 16 and the forward section 38 of the pad extends over the forward region 24 of the buck. Each of the straps 76 is then extended about the lower surface of the corresponding lobe 26 of the buck 16 to removably attach the pad 32 to the buck. The collar 36 is then placed in an open position on the rear section 34 of the pad 32 so that the collar is centered relative to the buck 16. The rearward section 34 of the pad 32 is then moved relative to the buck 16 so that the inner side 70 of the peripheral edge 68 of the hole 66 is aligned with the lateral edge 74 of the collar 36. The extender 72 then extends into the hole 66 so that the collar button 48 is within the peripheral edge 68 of the hole.

A shoulder region 80 of the shirt is then spread out over the forward section 38 of the pad 32 and the portion of the shirt between the collar 36 and shoulder section 80 is tucked downward into the spacing formed between the rearward section 34 and lobes 78 of the pad 32. This tucking smooths out the shoulder region 80 and the portion of the shirt below the outer fold 60 of the collar. The center of the shoulder region 80 is typically aligned with the yoke 42, and as noted above, the width of the yoke 42 is selected so that the center of the shoulder section may be pressed without wrinkling.

The pressing head 12 is then brought down to fit over the pad 32 and apply a downward pressing force on the collar 36. The pressing force compresses the pad 32; however, because the collar button 48 is within the area 64 having a thickness less than the thickness of the pad, little or no force is applied to the collar button 48 which prevents the breakage of the button. After a sufficient time has elapsed, the pressing head 12 may be raised and the shirt removed. If the next shirt to be pressed is not configured with a collar button 48, the pad 32 may be removed by slipping the straps 76 off of the forward region 24 of the buck 16 and removing the pad from the buck. Also, if the next shirt to be pressed has a collar button 48 and extender 72 attached to the other side of the collar 36, the pad 32 may be flipped over to place the area on the right side of the pad. The straps 76 may then be used to attach the pad 32 to the buck.

A specific embodiment of the novel collar pressing pad for dress shirts according to the present invention has been described for the purposes of illustrating the manner in which the invention may be made and used. It should be understood that implementation of other variations and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. A pressing device for use on a collar pressing apparatus, the pressing apparatus having a lower buck and a pressing head adapted to press against the buck to iron a collar placed in an open position between the buck and head, the collar having an outer fold portion forming a lateral edge and a button attached to a cloth extender which extends laterally outward from the lateral edge, said device comprising:

a pad removably attached to and covering a portion of the buck, said pad having a first thickness, said pad formed with a first section configured to allow the collar in the open position to be placed thereon, said first section having a side portion forming an area for receiving the button attached to the extender when the open collar is laid upon said first section, said area having a thickness less than said first thickness to accommodate the button when the pressing head is pressed against the collar on said pad.

2. The device of claim 1 wherein said area is defined by a peripheral border, said peripheral border including an inner section configured to be aligned with the lateral edge of the collar when the collar is laid upon said pad.

3. The device of claim 1 wherein said area includes a hole extending through said first section.

4. The device of claim 1 wherein said first section is comprised of two outer layers and a middle layer, said middle layer being resilient whereby the pressing of the pressing head against the pad on the buck compresses said pad from a second thickness to said first thickness.

5. The device of claim 1 further including resilient strap means attached to said pad for removably securing said pad to said buck and for allowing limited controlled movement of said pad relative to said buck.

6. The device of claim 1 wherein the buck includes a rear portion onto which the collar is spread, said rear portion having a generally rectangular periphery, the buck also including a front portion including two lobes extending forward at an acute angle from a forward side of the front portion to support a shoulder portion of a shirt, said buck having a convexly curved upper surface;

said pad including a second section covering said lobes and connected to said first section.

7. The device of claim 6 wherein said first section and said second section are connected to form a yoke.

8. A pressing device for use on a collar pressing apparatus, the pressing apparatus having a lower buck including a rear portion onto which an outer fold of a collar of a shirt is spread, said rear portion having a generally rectangular periphery, the outer fold portion of the collar forming a lateral edge, the collar also having a button attached to a cloth extender which extends laterally outward from the lateral edge, the buck also including a front portion including two lobes extending forward at an acute angle from a forward site of the front portion to support a shoulder portion of a shirt, said collar pressing apparatus also having a pressing head adapted to press against the buck to iron the collar, said pressing device comprising:

a pad removably attached to and covering a portion of the buck, said pad including a resilient middle layer having a first thickness; said middle layer being compressible by said pressing head, to a second compressed thickness; said pad formed with;

a first section covering at least a portion of the rear portion of said buck, said first section configured to allow the collar to be spread thereon, said first section having a side portion forming a hole to accommodate the button when the open collar is laid upon said first section and the pressing head is pressed against the collar on said pad, and a second section covering said lobes;

a yoke connecting said first section and said second section; and resilient strap means attached to said second section for removably securing said pad to said buck and for allowing limited controlled movement of said pad relative to said buck.

9. The device of claim 8 wherein said hole is defined by a peripheral border, said peripheral border including an inner section configured to be aligned with the lateral edge of the collar when the collar is laid upon said rear portion of said pad.

* * * * *